US005975782A

United States Patent [19]

Lee

[11] Patent Number: 5,975,782

[45] Date of Patent: Nov. 2, 1999

[54] FOUNTAIN APPLICATOR HANDLE

[76] Inventor: Kuo-Jium Lee, 10F, No. 69, Kang Ding Rd, Taipei, Taiwan

[21] Appl. No.: 09/192,383

[22] Filed: Nov. 16, 1998

[51] Int. Cl.[6] ..... B65B 3/01; B05C 1/10

[52] U.S. Cl. ..... 401/144; 401/189; 401/197; 141/20.5

[58] Field of Search ..... 401/144, 182, 401/189, 197; 141/20.5

[56] References Cited

U.S. PATENT DOCUMENTS

| | | | |
|---|---|---|---|
| 3,337,899 | 8/1967 | Rentfrow | 401/144 X |
| 4,732,503 | 3/1988 | Bader et al. | 401/197 |
| 4,824,272 | 4/1989 | Collins et al. | 401/197 |

*Primary Examiner*—Steven A. Bratlie
*Attorney, Agent, or Firm*—Rosenberg, Klein & Bilker

[57] ABSTRACT

A fountain applicator handle includes a body having a side part extending laterally therefrom the body, the side part communicating with the body. A neck section is defined in the first passage of the body and has a tapered shoulder defined in the first passage, the tapered shoulder located near the front end of the body to which a roller is attached. A control device has a bar extending radially from the first end thereof and an insert extends from the bar. An aperture is defined between the bar and the insert. The control device is movably inserted into the body and the insert is movably inserted into the side part. The bar normally close the second passage. A block has a tapered end thereof engaged with the tapered shoulder and is fixedly connected to the second end of the control device. A spring is mounted to the second end of the control device and biased in the neck section by the block such that the spring normally pushes the block away from the tapered shoulder and engages with the tapered shoulder when inserting a suction tube in the side part to lift the control device.

6 Claims, 4 Drawing Sheets

FOUNTAIN APPLICATOR HANDLE

FIELD OF THE INVENTION

The present invention relates to a fountain applicator handle, and more particularly, to an improved fountain applicator handle having a control means which is easiiy operated witnout specific skills and has a high etficiency.

BACKGROUND OF THE INVENTION

A conventional fountain applicator handle generally has a valve disposed in the body of the handle which is connected to a roller and a suction tube is inserted into a side part of the body to suck paint from a paint reservoir into the roller so that the paint can be applied onto a surface of an object such as a wall. A fountain applicator handle known to the applicant is disclosed in U.S. Pat. No. 4,810,123 to Bruggeman which is issued on Mar. 7, 1989. The fountain applicator handle of Bruggeman has a valve in the handle and has two plates, a tube is required to extend between the two plates to open the valve so as to suck the paint into the fountain applicator handle. However, the two plates are made of plastic material so that they tend to deform after a period of time of use, therefore, the could leak between the two plates. Furthermore, it requires a specific skill to insert the tube between the two plates and contact the neck portion of the passage.

The present invention intends to provide a fountain applicator handle which has a control means having a simple structure and is operated simply by inserting the suction tube into the side part to suck the paint into the reservoir. When the suction tube is removed from the side part of the handle, the control means is biased back to its initial position. The fountain applicator handle in accordance with the present invention has arisen to mitigate the disadvantages of the conventional fountain applicator handle.

SUMMATY OF THE INVENTION

In accordance with one aspect of the present invention, there is provided a fountain applicator handle comprising a body having a first passage defined longitudinally therethrough and a side part extending laterally from the body. The side part has a second passage defined therethrough which communicates with the first passage. A neck section is defined in theflrs passage and has a tapered shoulder defined in the first passage. The tapered shoulder is located near the front end of the body and the front end of the body is connected to a roller and the rear end of the body is connected to a piston means.

A control means has a bar extending radially from the first end thereof and an insert extends from the bar. An aperture is defined between the bar and the insert. The control means is movably inserted into the first passage and the insert is movably inserted into the side part. The bar normally closes the second passage. A block has a tapered end which is engaged with the tapered shoulder and fixedly connected to the second end of the control means. A spring is mounted to the second end of the control means and biased in the neck section bv contacting against the block. The spring normally pushes the block away from the tapered shoulder and the block is engaged with the tapered shoulder to seal the first passage when lifting the insert by inserting a suction tube into the side part.

The object of the present invention is to provide the fountain applicator handle having a control means which closes the passage of the body of the handle by simply inserting the suction tube into the side part without specific skill.

Further objects, advantages, and features of the present invention will become apparent from the following detailed description with appropriate reference to the accompanying drawings.

DETAILED DESCRIPTION OF THE PREFERRED EMBODIMENT

Figure 1:
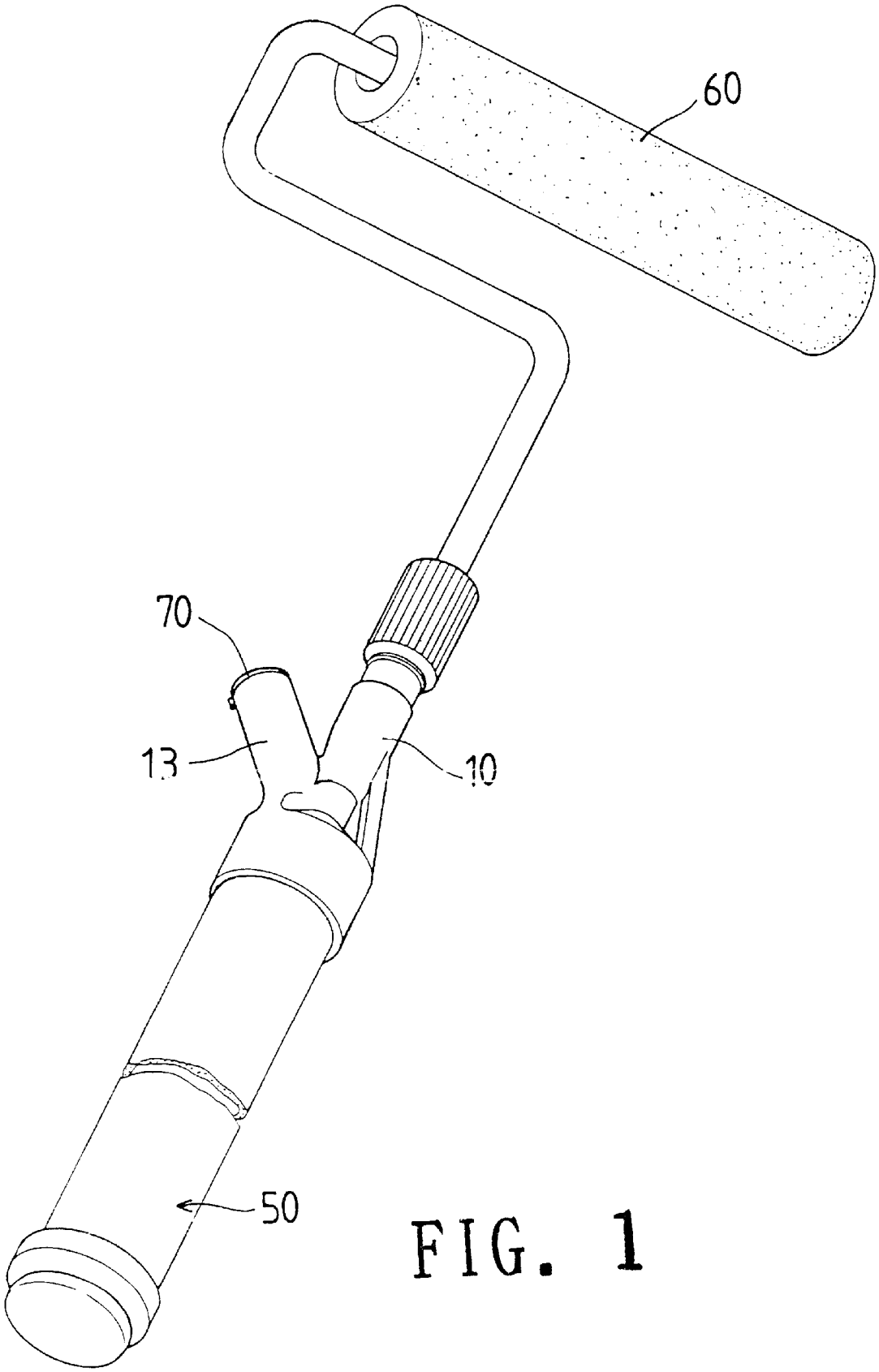
FIG. 1 is a perspective view of the fountain applicator handle in accordance with the presentiention.
Figure 2:
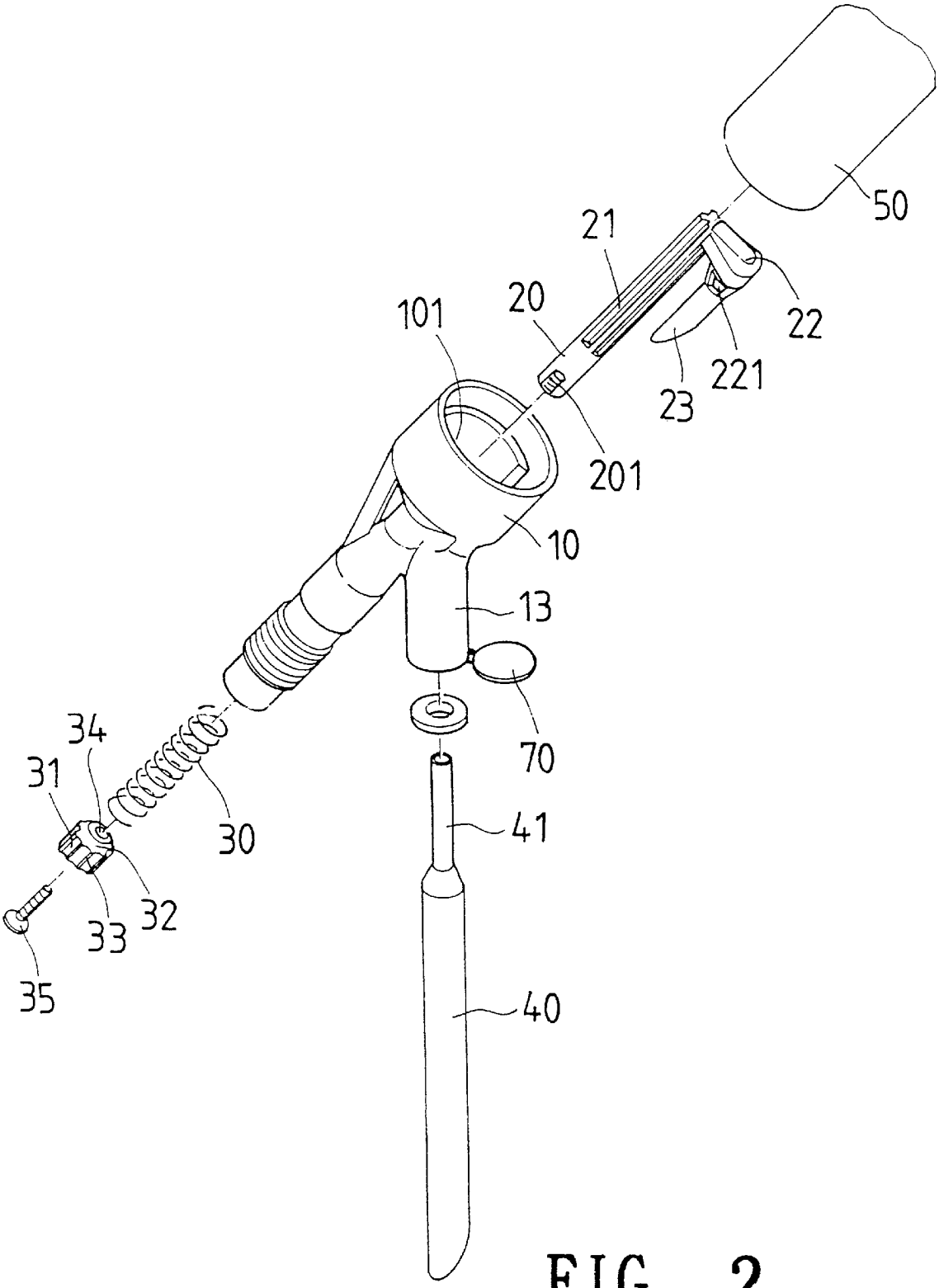
FIG. 2 is an exploded view of the fountain applicator handle in accordance with the present invention.

Referring to FIGS. 1 to 3 and 5, the fountain applicator handle in accordance with the present invention comprises a body having a first passage 101 defined longitudinally therethrough and a side part 13 extending laterally from the bode 10 whereip the side part 13 has a second passage 131 defined therethrough which communicates with the first passage 101. The front end of the body 10 is connected to a roller 60 and the rear end of the body 10 is connected to a piston means 50. A neck section 15 is defined in the first passage 101 and has a tapered shoulder 102 defined in the first passage 101, the tapered shoulder located near the front end of the body 10. A cap 70 is hinged to the lower open end of the side part 13 so that the lower open end can be closed by the cap 70.

A cylindrical control means 20 has a bar 22 extending radially from the first end thereof and an insert 23 extends from the bar 22. A neck is connected between the bar 22 and the insert 23 wherein the neck has an aperture 221 defined therethrough, the insert 23 having a third passage 231 defined therethrough which commuicates eith the aperture 221. The bar 22 normally seals the third passage 231. The control means 20 has a plurality of grooves 21 defined in the outside of the first end thereof and a threaded hole 201 defined in the second end of the control means 20. The control means 20 is movably inserted into the first passage 101 and the insert 23 is movably inserted into the side part 13 wherein the bar 22 normally closes the second passage 131 of the side part 13. A block 31 having a tapered end 32 which is engaged with the tapered shoulder 102 and fixedly connected to the second end of the control means 20 by extending a bolt 35 through the longitudinal hole 34 defined longitudinally through the block 31 and engaged with the threaded hole 201. A spring 30 is mounted to the second end of the control means 20 and biased between the neck section 15 and the block 31 such that the spring 30 normally pushes the block 31 away from the tapered shoulder 102. The block 31 has a plurality of grooves 33 defined in the outside thereof.

Figure 3:
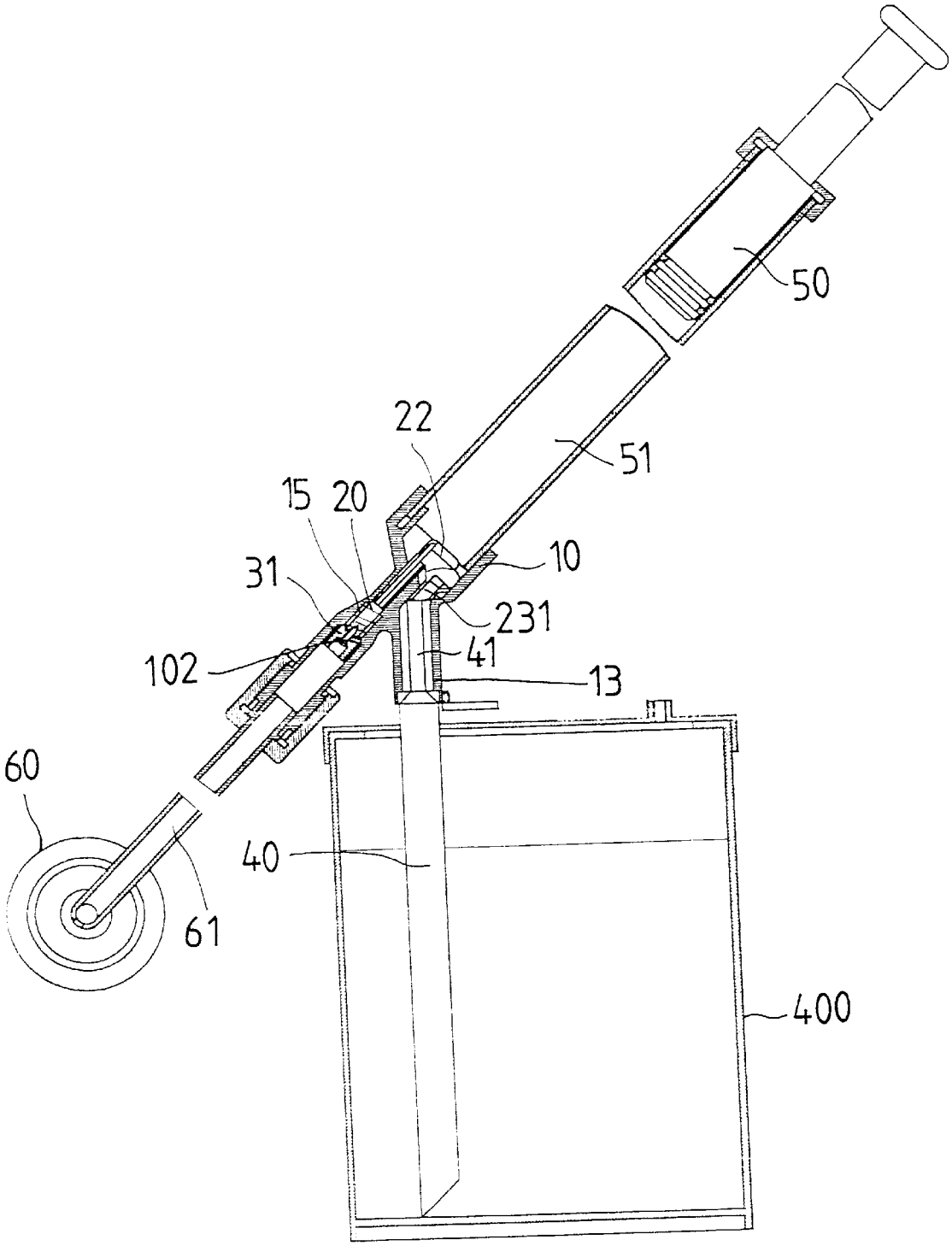
FIG. 3 is a side elevatiuial view, partly in sectioii, of the fountain applicator handle which is cnnected with a suction tube to suck paint into the reservoir.
Figure 4:
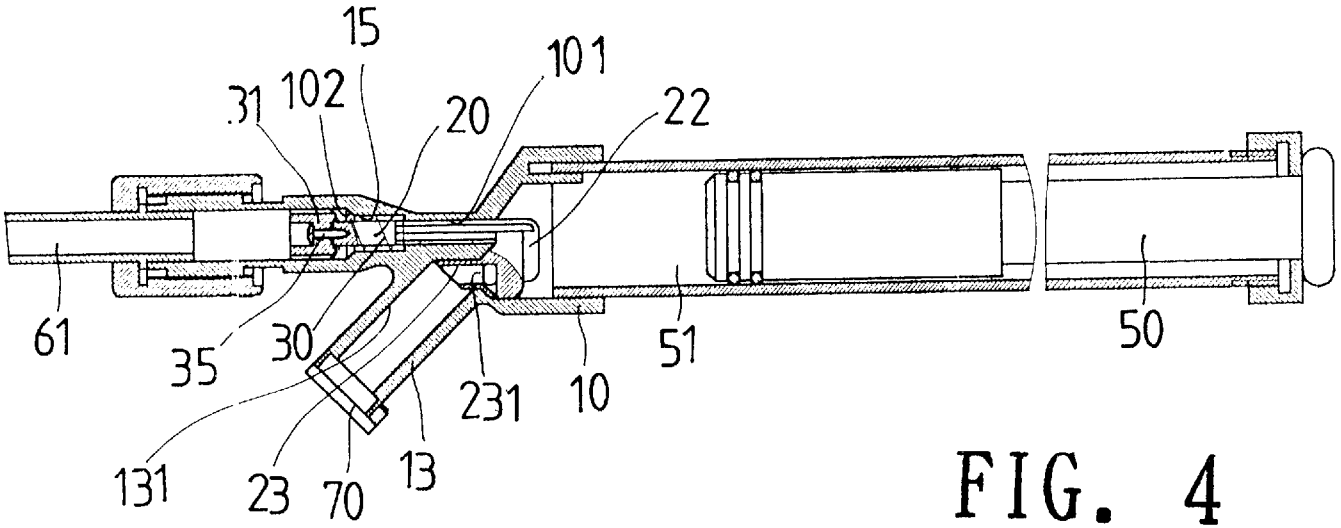
FIG. 4 is a side elevational view, partly in section, of the fountain applicator handle when the side part is closed by a cap.

When sucking the paint from a paint tank 400 as shown in FIG. 3. the cap 70 is pivoted from the lower open end of the side part 13 and inserting a suction tube 40 in the side part 13. The front section 41 of the suction tube 40 pushes the insert 23 together with the bar 22 to open the second passage 131. In the meanwhile, the block 31 connected to the control means 20 is also moved to engage with the tapered shoulder 102 by its tapered end 32 so as to seal the first passage 101 such that when operating the piston means 50, the paint will be sucked from the tank 400 into the reservoir 51 of the piston means 50 via the second passage 131, the third passage 231 and the aperture 221.

Figure 5:
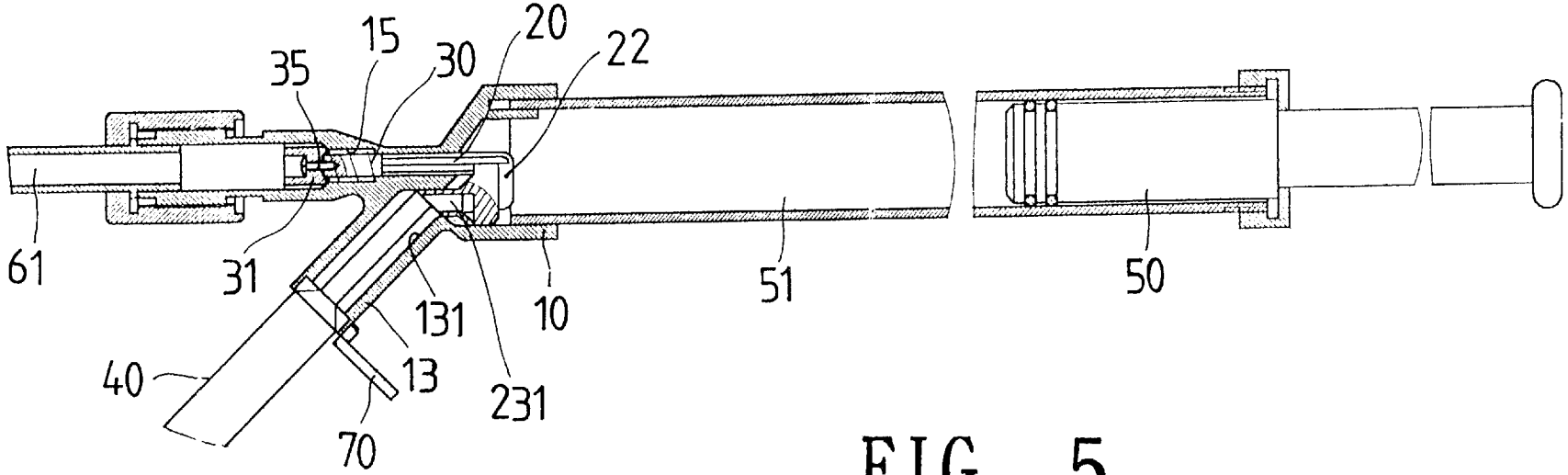
FIG. 5 is a side elevational view, partly in section, of the fountain applicator handle wherein the piston means is operated to suck the paint into the reservoir.

Referring to FIG. 5, when the paint is filled in the reservoir 51, the suction tube 40 is removeu froiii the side part 13 and the block 31 will return to its original position by the spring 30. The cap 70 is then closed on side part 13 and the paint in the reservoir 51 is pushed by operating the piston means 50 to flow to the roller 60 via the grooves 21 of the control means 20, the first passage 101, the neck section 15, the grooves 33 in the block 31 and the tube 61 connected to the roller 60.

The insertion of the suction tube 40 needs no specific skill and the engagement of the block 31 and the tapered shoulder 102 is reliable so that the fountain applicator handle overcomes the disadvantages of the conventional fountain applicator handle. Furthermore, when ejecting the paint in the reservoir 51 into the roller 60, the cap 70 closes the side part 13 so that the paint flows efficiently.

The invention is not limited to the above embodiment but various modification thereof may be made. It will be understood by those skilled in the art that various changes in form and detail may made without departing from the scope and spirit of the present invention.

What is claimed is:

1. A fountain applicator handle comprising:

a body having a first passage defined longitudinally therethrough and a side part extending laterally from said body, said side part having a second passage defined therethrough which cornmuncates with said first passage, a neck section defined in said first passage and having a tapered shoulder defined in said first passage, said tapered shoulder located near the front end of said body, the front end of said body adapted to be connected to a roller and the rear end of said body 10 adapted to be connected to a piston means, and a control means having a bar extending radially from the first end thereof and an insert extending from said bar, an aperture defined between said bar and said insert, said control means movably inserted into said first passage and said insert movably inserted into said side part, said bar normally closing said second passage, a block having a tapered end which is engaged with said tapered shoulder and fixedly connected to the second end of said control means, a spring mounteed to the second end of said control means and biased in said neck section such that said spring normally pushes said block away from said tapered shoulder.

2. The fountain applicator handle as claimed in claim 1 further comprising a cap hinged to said side part so as to close said side part.

3. The fountain applicator handle as claimed in claim 1, wherein said block has a plurality of grooves defined in the outside thereof.

4. The fountain applicator handle as claimed in claim 1, wherein said control means has a plurality of grooves defined in the outside of the first end thereof.

5. The fountain applicator handle as claimed in claim 1 further comprising a bolt extending through said block and connected to the first end of said control means.

6. The fountain applicator handle as claimed in claim 1, wherein said insert has a third passage defined therethrough which communicates with said aperture.

* * * * *